United States Patent [19]

Neumann

[11] 4,130,789

[45] Dec. 19, 1978

[54] TAP CHANGING VOLTAGE REGULATOR WHICH ELIMINATES PREVENTIVE AUTOTRANSFORMER

[75] Inventor: Manfred E. Neumann, New Berlin, Wis.

[73] Assignee: Allis-Chalmers Corporation, Milwaukee, Wis.

[21] Appl. No.: 818,987

[22] Filed: Jul. 25, 1977

[51] Int. Cl.[2] ..... G05F 1/14

[52] U.S. Cl. ..... 323/43.5 R; 200/11 TC; 323/45

[58] Field of Search ..... 323/43 SR, 43.5 S, 45; 200/11 TC

[56] References Cited

U.S. PATENT DOCUMENTS

| | | | |
|---|---|---|---|
| 3,427,530 | 2/1969 | Oakes et al. | 323/43 SR |
| 3,513,380 | 5/1970 | Vargo | 323/43 SR |
| 3,612,789 | 10/1971 | Whitman | 200/11 TC |
| 3,691,495 | 9/1972 | Conway | 323/43 SR |
| 3,875,354 | 4/1975 | Dusek | 200/11 TC |

*Primary Examiner*—Gerald Goldberg
*Attorney, Agent, or Firm*—Lee H. Kaiser

[57] ABSTRACT

Tap changer voltage regulating apparatus permits a tap changer selector contact to engage an open-circuited new tap without arcing and has a half-tap voltage auxiliary winding which permits halving the voltage being interrupted and doubling the number of steps and also has an auxiliary switch which initially connects the selector contact on the new tap in series with a circulating current-limiting inductor and the load to prevent load circuit interruption and then opens the previous tap circuit so that circulating current is interrupted at reduced voltage and then short circuits the inductor to complete the tap change, whereby the inductor is energized only momentarily.

9 Claims, 12 Drawing Figures

TAP CHANGING VOLTAGE REGULATOR WHICH ELIMINATES PREVENTIVE AUTOTRANSFORMER

BACKGROUND OF THE INVENTION

This invention relates to voltage magnitude control systems and particularly to those of the tap changing type.

A step voltage regulator is an autotransformer provided with load ratio control equipment for regulating the voltage on the feeder or bus to which it is connected. A typical step voltage regulator may have a 100 percent exciting winding in shunt with the line on the source side and normally maintains the voltage on the load side within a desired voltage bandwidth by a 10 percent tapped buck/boost winding in series with the line. The series winding has taps connected to the stationary contacts of a tap changer dial switch having a pair of rotatable selector contacts driven by a reversible motor into sequential engagement with the stationary contacts and usually provides the ability to change the effective turns ratio from input to output plus and minus 10 percent in 32 steps of ⅝ percent voltage increments. The rotatable contacts of the tap changer switch are usually connected through slip rings to the opposite ends of a bridging center-tapped autotransformer reactor, termed a preventive autotransformer, to permit transition from one tap position to another without interrupting the load circuit. When the selector contacts bridge adjacent stationary contacts, the high reactance of the preventive autotransformer limits circulating current to a safe value and thus reduces burning and erosion of the tap changer contacts and also provides a voltage midway between the physical taps to thereby provide twice the number of steps. However, such a preventive autotransformer has continuous energy losses in operation, is bulky, and is expensive to construct. Further, substantial arcing occurs at the tap changer dial switch contacts of a regulator employing a preventive autotransformer due to inductive energy storage even when the selector contacts are operated with quick-break action during each tap change, and such arcing necessitates the use of expensive arc resistant material for the contacts and also contaminates the oil in which the tap changer switch is immersed.

OBJECTS OF THE INVENTION

It is an object of the invention to provide an improved tap changer voltage regulator which permits elimination of the bulky and costly preventive autotransformer used in prior art apparatus. It is a further object of the invention to provide such a tap changer voltage regulator wherein the circulating current limiting means does not have continuous energy losses and arcing at the tap changer switch contacts is eliminated so such contacts do not have to be of arc resistant material.

DESCRIPTION OF THE DRAWING

The above and other objects and advantages of the invention will be more readily apparant from the following detailed description when considered with the accompanying drawing wherein.

Figure 1:
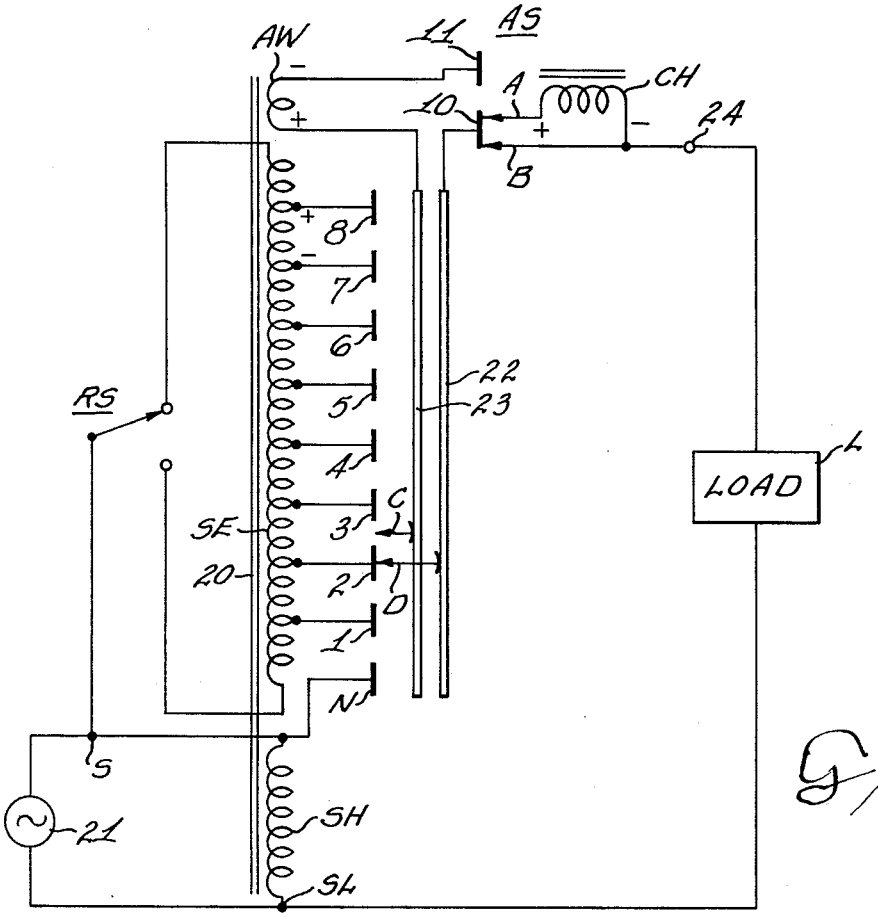
FIG. 1 is a schematic circuit diagram of a preferred embodiment of the invention.
Figure 3:
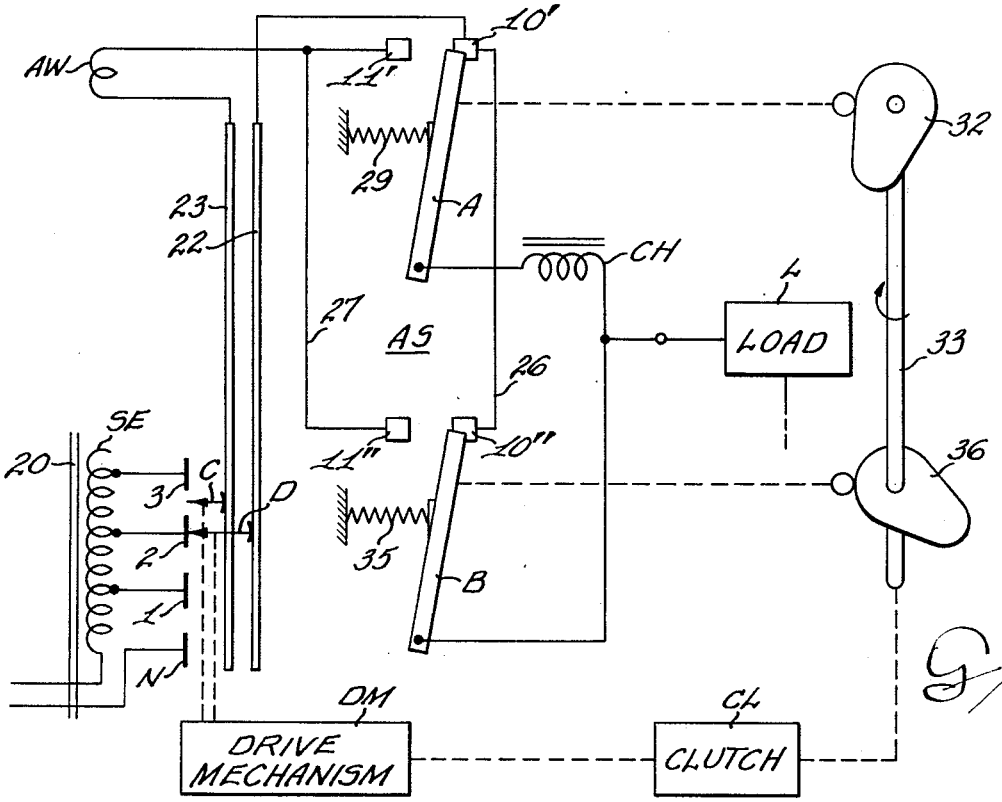
Figure 2A:
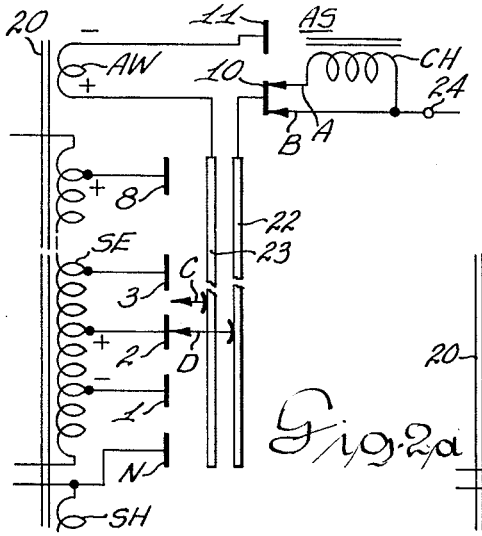
Figure 2C:
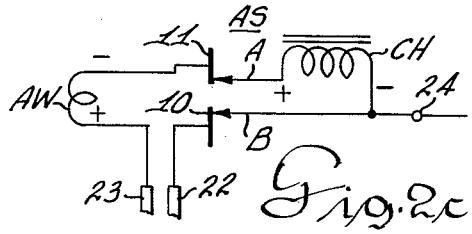
Figure 2B:
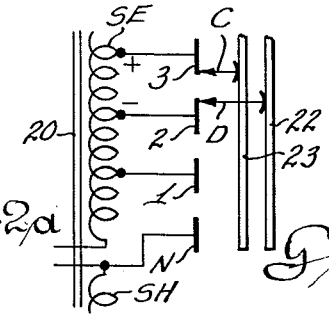
Figure 2D:
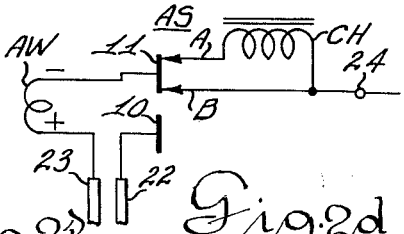
Figure 2E:
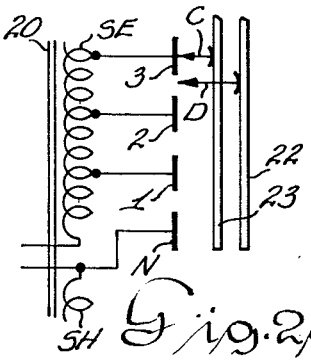
Figure 2F:
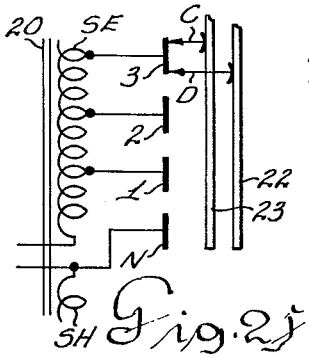
Figure 2G:
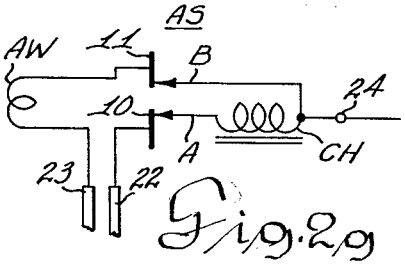
Figure 2H:
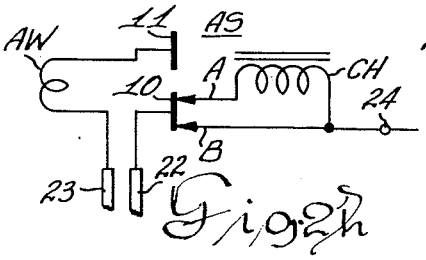
Figure 2I:
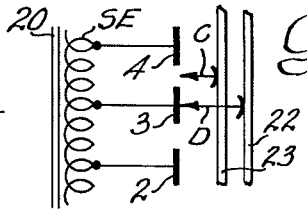
Figure 4:
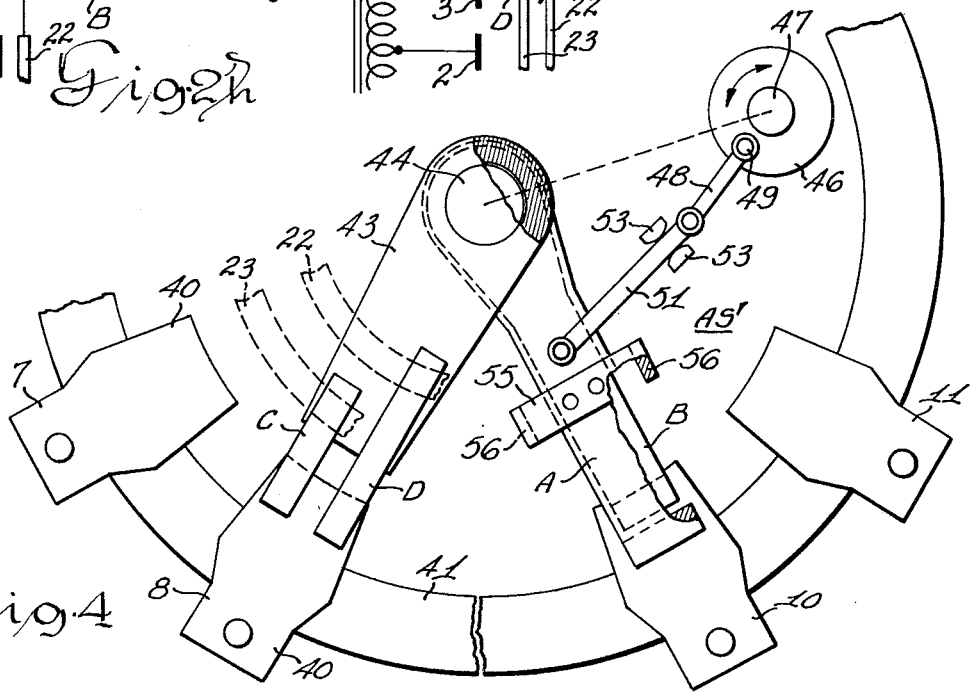

FIGS. *2a–2i* schematically illustrate positions of the elements of the FIG. 1 arrangement during two successive tap changes in the voltage raising direction;

FIG. 3 schematically illustrates a preferred form of the auxiliary switch shown in FIG. 1; and FIG. 4 shows an alternative form of auxiliary switch.

SUMMARY OF THE INVENTION

A tap changer voltage regulating arrangement embodying the invention permits a tap changer selector contact to engage an open-circuited new tap in either direction without arcing and has a half-tap voltage auxiliary winding which halves the switching voltage and permits doubling the number of steps and also has an auxiliary switch which initially connects the selector contact on the new tap in series with a circulating current-limiting inductor and the load to prevent load circuit interruption and then opens the former tap circuit so that circulating current is interrupted at reduced voltage and then short circuits the inductor to complete the tap change, whereby the inductor is energized only momentarily.

DETAILED DESCRIPTION

A step voltage regulator embodying the invention illustrated in FIG. 1 has a 100 percent exciting winding SH which inductively links a magnetic core 20 and is connected across the regulator S and SL bushings which are adapted to be connected to an alternating current source 21 such as a power line to be regulated. The regulator also has a 10 percent series winding SE which inductively links magnetic core 20 and is connected in series with the power line and is provided with a plurality of taps connected to the stationary contacts 1–8 of a tap changer switch, which contacts are preferably arranged in a circle (not shown). The same reference numerals 1–8 are used to indicate both the stationary contacts and the taps of winding SE to which they are connected. One side of shunt winding SH is connected to a stationary neutral contact N and is also connected to the respective ends of series winding SE by an automatic, mechanically operated reversing switch RS which reverses the polarity of series winding SE so that it may be connected in bucking or boosting relation with shunt winding SH and thereby doubles the range of the tap changer. Two movable selector contacts C and D are preferably rotatable and sequentially engage the stationary contacts. Only one movable selector contact C or D is in engagement with a stationary contact in the quiescent state of the tap changer switch in the disclosed embodiment, and selector contacts C and D are in bridging relation with adjacent stationary contacts (FIG. *2b*) or on the same contact (FIG. *2f*) only during a tap change. Selector contacts C and D slidably engage conductive collectors 23 and 22 respectively which preferably are slip rings in concentric relation with the circle of stationary contacts 1–8 and N.

A half-tap voltage auxiliary winding AW inductively linking magnetic core 20 has approximately one-half as many turns as the number of turns between adjacent taps of series winding SE so auxiliary winding AW derives a full-step voltage, or half-tap voltage. Preferably, auxiliary winding AW is wound to oppose the voltage of series winding SE, but in alternative embodiments (not shown) auxiliary winding AW is in aiding relation to winding SE. One side of auxiliary winding AW may be connected to slip ring 23, and the other side may be connected to the second stationary contact 11 of an auxiliary switch AS whose first stationary contact 10 is connected to slip ring 22. Auxiliary switch AS is preferably operated synchronously with tap changer switch selector contacts C and D by a common drive mechanism (not shown), and auxiliary switch As has a first movable contact A and a second movable contact B, both of which normally engage the same stationary contact 10 or 11 and are adapted to step between stationary contacts 10 and 11 so that the first movable contact A always disengages the one stationary contact and engages the other stationary contact before the second movable contact B leaves the one stationary contact. A preferred auxiliary switch structure is schematically illustrated in FIG. 3 and an alternative auxiliary switch construction is schematically shown in FIG. 4. The first movable contact A is connected through an inductive choke CH to an output lead, or terminal 24 and the second movable contact B is connected to output lead 24. The disclosed arrangement is adapted to regulate voltage supplied to a load L connected between output lead 24 and the SL bushing.

FIGS. *2a* to *2i* illustrate two successive tap changes in the voltage raising direction. In FIG. *2a* selector contact D is on tap changer switch stationary contact 2, selector contact C is between statonary contacts 2 and 3, and auxiliary switch movable contacts A and B engage auxiliary switch stationary contact 10. The electrical circuit to the load may be traced from bushing S, reversing switch RS, one end of winding SE, stationary contact 2, selector contact D, slip ring 22, auxiliary switch stationary contact 10, movable contact B, output lead 24, and load L to bushing SL.

It will be apparent that selector contact C is free to move to a new tap in the raise direction without arcing since it is open-circuited at auxiliary switch stationary contact 11 and thus is not carrying current. In FIG. *2b* selector contact C has been moved arclessly into engagement with stationary contact 3 while selector contact D remains on stationary contact 2. Operation of auxiliary switch AS to effect a tap change is initiated by movable contact A leaving stationary contact 10 and engaging stationary contact 11 while movable contact B remains in engagement with stationary contact 10, as shown in FIG. *2c*, thereby completing a circuit to the load which may be traced from tap changer switch stationary contact 3, selector contact C, slip ring 23, auxiliary winding AW, auxiliary switch stationary contact 11, first movable contact A, and choke CH to output lead 24 and one side of load L, thereby preventing interruption of the load circuit during the tap change. The voltage tending to cause circulating current during the tap change is only a half-tap potential since the half-tap voltage of auxiliary winding AW opposes the full-tap voltage between taps 2 and 3 of winding SE. The current through inductive choke CH, which is in series with the load, cannot change instantaneously when first movable contact A engages stationary contact 11 but rather must build up from zero through the choke CH, so no current is flowing through first movable contact A when it engages stationary contact 11 and it thus closes without arcing. Auxiliary switch AS then disengages movable contact B from stationary contact 10 and engages it with stationary contact 11 as shown in FIG. *2d*. Arcing occurs at movable contact B when it leaves stationary contact 10 since it is interrupting circulating current, but the arc energy is substantially reduced, in comparison to prior art regulators which employ a preventive autotransformer, since the interruption voltage is decreased to half-tap voltage (which is only one-half the switching voltage of the prior art apparatus) minus the voltage drop across choke CH. When movable contact B engages stationary contact 11, the current flowing through contact B must begin from zero since inductor CH prevents rapid changes of current, and consequently contact B closes arclessly with stationary contact 11. Inductor CH is short circuited and thus removed from the load circuit when contact B engages stationary contact 11, and it will be apparent that the energy losses in choke CH are of short duration since they only occur during tap changes. The tap changer switch moves the selector contacts into the position shown in FIG. *2e* to complete the tap change wherein selector contact C is on stationary contact 3 and selector contact D is between stationary contacts 2 and 3.

Assuming that the regulator voltage sensor again calls for a tap change in the direction to increase the voltage supplied to load L, selector contact D is moved without arcing into engagement with tap changer switch stationary contact 3 while selector contact remains on stationary contact 3 as shown in FIG. *2f*. Auxiliary switch As is again operated and initially disengages first movable contact A from stationary contact 11 and into engagement with stationary contact 10 while movable contact B remains in engagement with stationary contact 11, as shown in FIG. *2g*. No arcing occurs as contact A closes with stationary contact 10 inasmuch as inductor CH is in series with movable contact A and the current through inductor CH builds up from zero. The voltage tending to cause circulating current in the position shown in FIG. *2g* is the relatively low half-tap potential of auxiliary winding AW. Auxiliary switch As then actuates movable contact B into engagement with stationary contact 10 to short circuit inductor CH as illustrated in FIG. *2h*. Arcing occurs as movable contact B leaves stationary contact 11 since circulating current is being interrupted, but the arc energy is again substantially reduced in comparison to prior art apparatus having a preventive autotransformer since the voltage being interrupted is only the half-tap voltage of auxiliary winding AW minus the voltage drop across inductor CH. Further, contact B closes arclessly with stationary contact 10 since inductor CH prevents sudden current changes. Also losses in choke CH are of short duration and occur only during the tap change. The tap changer switch moves the selector contacts into the position shown in FIG. *2i* to complete the tap change wherein selector contact C is between stationary contacts 3 and 4 and selector contact D is on stationary contact 3.

FIG. 3 schematically illustrates a preferred form of auxiliary switch AS which is disclosed in the aforementioned copending application of Manfred E. Neumann and Robert G. Hammond. Auxiliary switch stationary contact 10 comprises two stationary conductive portions 10' and 10'' connected together by a lead 26 and also connected to slip ring 22, and stationary contact 11 comprises two stationary conductive portions 11' and 11'' connected together by a lead 27 and also connected to one side of auxiliary winding AW. Auxiliary switch movable contact A is of the pivoted knife blade type and is resiliently urged by a compression spring 29 into engagement with stationary contact portion 10' and is operatively associated with a cam 32 mounted on a camshaft 33 and adapted to be operated by cam 32 into engagement with stationary contact portion 11' against the force of spring 29 and also to be returned by spring 29 under the control of cam 32 into engagement with stationary contact portion 10'. Similarly auxiliary switch movable contact B is of the pivoted knife blade type resiliently urged by a compression spring 35 into engagement with stationary contact portion 10'' and is operatively associated with a cam 36 mounted on a camshaft 33 and adapted to be operated by cam 36 into engagement with stationary contact portion 11'' against the force of spring 35 and also to be returned by spring 35 under the control of cam 36 into engagement with stationary contact portion 10''. Tap changer selector contacts C and D are operated by a suitable drive mechanism DM which also synchronously drives camshaft 33 through a suitable one-way clutch CL so that camshaft 33 has unidirectional rotation. It will be appreciated that cam 32 is mounted on camshaft 33 relative to cam 36 so that knife blade contact A always disengages stationary contact portion 10' and engages portion 11' before cam 36 operates knife blade contact B in making a tap change, and also that cam 32 permits knife blade contact A to be returned by spring 29 into engagement with stationary contact portion 10' before cam 36 permits movement of knife blade contact B by spring 35 in making a tap change.

FIG. 4 schematically illustrates an alternative form of auxiliary switch AS' in which the auxiliary switch stationary contacts 10 and 11 are disposed in the same circle as the tap changer switch stationary contacts 1–8 and N. Such stationary contacts may comprise generally radially extending conductive members 40 inserted into circumferentially spaced openings in the axially facing surface of an annular insulating ring 41. Tap changer selector contacts C and D may comprise radially extending conductive fingers mounted on an insulating block 43 affixed to a rotatable shaft 44 having its axis coincident with the center of the circle of stationary contacts, and selector contacts C and D may terminate at different positions in a radial direction and engage respective slip rings 23 and 22 shown in dotted lines. Auxiliary switch movable contacts A and B may comprise generally superimposed radially extending conductive members insulated from each other and having ring-shaped ends which freely surround shaft 44. Movable contact A may extend further in a radial direction than movable contact B and be disposed above and in spaced relation to B and have a depending portion at its radially outer end which slidably engages stationary contacts 10 and 11 alternatively. Movable contact B may be shorter in a radial direction than contact A and may also slidably engage stationary contacts 10 and 11 alternatively.

A circular crank 46 is affixed to a shaft 47 which is operated by the same drive mechanism (not shown) that actuates shaft 44 so that shafts 44 and 47 are synchronously driven. An operating link 48 is pivotally connected at one end to a crank pin 49 secured to crank 46 and is pivotally connected at its other end to one end of a reciprocal second link 51 whose other end is pivotally secured to contact A. Second link 51 may reciprocate within suitable guides 53 as crank 46 rotates and thus pivot contact A so that is alternatively engages stationary contacts 10 and 11. An inverted U-shaped insulating member 55 affixed to contact A has depending portions 56 spaced apart by a greater distance than the width of contact B and which abut against the sides of contact B and actuate it out of engagement with one stationary contact 10 or 11 and into engagement with the other only after contact A has left the one stationary contact and engaged the other.

My invention is also applicable to other load ratio control tap changer arrangements such as an auto-transformer connection wherein the tapped winding SE is between the power source 21 and the winding SH and the load is coupled across winding SH; or a two-winding transformer with a tapped winding portion in series with the primary or the secondary winding; or a load ratio control circuit wherein a series transformer is used to add a voltage to the main winding of a transformer or to subtract it, and the tapped transformer winding may carry a separate load or may be a tertiary winding or may be the main winding.

While only a few embodiments of my invention have been illustrated and described, many modifications and variations thereof will be readily apparent to those skilled in the art, and consequently I do not intend to be limited to the particular embodiments shown and described.

The embodiments of the invention in which an exclusive property or privilege is claimed are defined as follows:

1. In a tap changer voltage regulating arrangement having a magnetic core linked by an exciting winding and by a tapped winding provided with a plurality of taps and also having first and second movable selector contacts adapted to sequentially engage said tape, the improvement comprising a half-tap voltage auxiliary winding linking said magnetic core, and an auxiliary switch having first and second stationary contacts coupled respectively to one end of said auxiliary winding and to one of said selector contacts and also having first and second movable contacts normally engaging the same stationary contact and adapted to be stepped between said stationary contacts so that said first movable contact always disengages one stationary contact and engages the other stationary contact before said second movable contact disengages said one stationary contact, the other selector contact being coupled to the other end of said auxiliary winding, said auxiliary switch second movable contact being coupled to a terminal and said auxiliary switch first movable contact being coupled through an inductive choke to said terminal.

2. In the voltage regulating arrangement of claim 1 and including reversing switch means for alternatively connecting the respective ends of said tapped winding to one side of said exciting winding so that said tapped winding may be in bucking or boosting relation to said exciting winding.

3. In the voltage regulating arrangement of claim 2 wherein said exciting winding is adapted to be connected across an alternating current source, whereby the voltage may be regulated to a load connected between said terminal and the other side of said exciting winding without appreciable arcing at said selector contacts or at said auxiliary switch first movable contact.

4. Tap changer voltage regulating apparatus comprising, in combination, a magnetic core, an exciting winding linking said magnetic core, a tapped winding linking said magnetic core and having a plurality of taps, a half-tap voltage auxiliary winding linking said magnetic core, the number of turns of said auxiliary winding being approximately one-half the number of turns between adjacent taps of said tapped winding, first and second tap changer movable selector contacts adapted to sequentially engage said taps, an auxiliary switch having first and second stationary contacts, first and second movable contacts normally engaging the same stationary contact, and means for stepping said movable contacts alternately between said first and second stationary contacts so that said first movable contact always disengages one stationary contact and engages the other before said second movable contact disengages said one stationary contact, the first and second ends of said auxiliary winding being respectively coupled to said auxiliary switch first stationary contact and to one of said selector contacts and the other selector contact being coupled to said auxiliary switch second stationary contact, and an inductor, said auxiliary switch first movable contact being coupled through said inductor to a lead and said auxiliary switch second movable contact being coupled to said lead, whereby voltage may be regulated without appreciable arcing at said selector contacts or at said auxiliary switch first movable contact.

5. Tap changer voltage regulating apparatus in accordance with claim 4 and including reversing switch means for selectively coupling the respective ends of said tapped winding to one end of said exciting winding so that said tapped winding may be in bucking or boosting relation to said exciting winding.

6. A tap changer voltage regulating arrangement comprising, in combination, a magnetic core, a tapped electrical winding linking said magnetic core and having a plurality of taps, a half-tap voltage auxiliary winding linking said magnetic core, first and second tap changer movable selector contacts adapted to sequentially engage said plurality of taps, one of said selector contacts being coupled to one side of said auxiliary winding, an auxiliary switch having first and second stationary contacts coupled respectively to the other side of said auxiliary winding and to the other selector contact and also having first and second movable contacts normally engaging the same stationary contact and adapted to be stepped alternatively between said first and second stationary contacts so that said first movable contact always leaves one stationary contact and engages the other before said second movable contact leaves said one stationary contact, and an inductor, said auxiliary switch first movable contact being coupled through said inductor to a terminal and said auxiliary switch second movable contact being coupled to said terminal.

7. A tap changer voltage regulating arrangement in accordance with claim 6 and including an exciting winding linking said magnetic core.

8. A tap changer voltage regulating arrangement in accordance with claim 7 and including reversing switch means for selectively connecting the respective ends of said tapped winding to said one of said exciting winding so that said tapped winding may be in bucking or boosting relation to said exciting winding.

9. A tap changer voltage regulating arrangement in accordance with claim 6 and including a plurality of tap changer stationary contacts arranged in a circle and comprising said taps which said selector contacts are adapted to engage, and also including first and second collector rings concentric to said circle in sliding electrical engagement with said first and second selector contacts respectively and electrically connected to said first end of said auxiliary winding and to said auxiliary switch second stationary contact respectively.

* * * * *